US007708647B2

(12) United States Patent
Connell et al.

(10) Patent No.: US 7,708,647 B2
(45) Date of Patent: May 4, 2010

(54) LED LIGHT AND SOUND SYSTEM FOR BOWLING PIN DECK

(76) Inventors: Ronald B. Connell, 1300 Bailey Rd., Apt. 10, Cuyahoga Falls, OH (US) 44221; Edmond Gazdacko, 13321 Carnation Ave., N.W., Hartville, OH (US) 44632

( * ) Notice: Subject to any disclaimer, the term of this patent is extended or adjusted under 35 U.S.C. 154(b) by 127 days.

(21) Appl. No.: 11/820,116

(22) Filed: Jun. 18, 2007

(65) Prior Publication Data

US 2008/0312004 A1 Dec. 18, 2008

(51) Int. Cl.
*A63D 1/00* (2006.01)
*F21S 4/00* (2006.01)

(52) U.S. Cl. ..... 473/54; 473/73; 362/217.01; 362/249.02

(58) Field of Classification Search ..... 473/54, 473/73, 101; 362/217.01, 219, 227, 249.02, 362/249.06, 800

See application file for complete search history.

(56) References Cited

U.S. PATENT DOCUMENTS 2,330,484 A * 9/1943 Finazzo ..... 362/33
2,572,456 A * 10/1951 Durant et al. ..... 273/126 A
2,643,884 A * 6/1953 Koci ..... 473/74
4,597,575 A * 7/1986 Kosof ..... 473/54
4,629,189 A * 12/1986 Meniconi ..... 473/69
5,628,692 A * 5/1997 Mowers et al. ..... 473/73
5,800,274 A * 9/1998 Widrick et al. ..... 473/54
5,846,138 A * 12/1998 Borden et al. ..... 473/54
5,882,263 A * 3/1999 Chung ..... 473/70
5,888,142 A * 3/1999 Perrier ..... 473/54
5,899,815 A * 5/1999 Helou et al. ..... 473/54
6,031,343 A * 2/2000 Recknagel et al. ..... 315/292
6,142,880 A * 11/2000 Titus ..... 473/54
6,166,496 A * 12/2000 Lys et al. ..... 315/316
6,304,789 B1 * 10/2001 Shea ..... 700/92
6,912,432 B1 * 6/2005 Shea ..... 700/91
7,025,687 B2 * 4/2006 Bouchard ..... 473/54
7,453,217 B2 * 11/2008 Lys et al. ..... 315/291
7,525,254 B2 * 4/2009 Lys et al. ..... 315/77
7,598,686 B2 * 10/2009 Lys et al. ..... 315/312

* cited by examiner

*Primary Examiner*—William M Pierce
(74) *Attorney, Agent, or Firm*—Renner, Kenner, Greive, Bobak, Taylor & Weber

(57) ABSTRACT

A light and sound system for a bowling pin deck includes a controller interposed between a music system and a light assembly connected to a forward end of a pin setter assembly and positioned forwardly and above a bowling pin deck. The light assembly includes a rearwardly and downwardly projecting light arrangement of colored and infrared LEDs mounted upon a light plate. Positioned above the light plate is a standard fluorescent bulb for uniform traditional illumination of the pin deck. The LEDs are configured and positioned for full illumination of the pin deck in various colors including red, green and blue, which are illuminated by a controller either independently of or in conjunction with the music system. During all periods, the infrared LEDs are illuminated to operate in conjunction with the automatic scorer.

17 Claims, 2 Drawing Sheets

LED LIGHT AND SOUND SYSTEM FOR BOWLING PIN DECK

TECHNICAL FIELD

The invention herein resides in the art of recreational devices and systems. More particularly, the invention relates to the game of bowling and physical structures incident thereto. Specifically, the invention relates to a light and sound system for the bowling pin deck.

BACKGROUND ART

The sport of bowling has been long lived and enjoyed by countless millions of people. Many bowling establishments provide leagues for competitive bowling, where the bowlers play the sport according to sanctioned rules. But, there are those less serious about the sport, bowling simply for relaxation, fellowship, or at parties at the bowling establishment to celebrate birthdays, retirements, and the like. The recreational and party bowler typically is less interested in the stringent rules of sanctioned bowling, and more interested in the pleasure and entertainment aspects of the game. To add to the enjoyment of bowling for the pleasure bowler, bowling establishments have progressively turned to enhancing their bowling environment with music and lighting systems. The application of fluorescent materials to pins, balls, lanes, walls and the like, to be illuminated by fluorescent or black light are commonly known. Moreover, sound systems providing either background music or overriding music within the establishment are also routine. However, these known systems typically focus on the overall environment of the bowling establishment, rather than on the pin deck itself. Since the focus of the game of bowling is on the pins set upon the pin deck, lights, colors, sounds and music that are disassociated with the deck are often more distracting than facilitating, and serve to detract from the enjoyment of the game, rather than adding to it.

There remains a need in the art for a sound and music system directed to and associated with the pin deck itself. Moreover, since most bowling establishments now employ automatic scorers that require infrared lighting and sensing, such systems must be of such a nature as to complement the automatic scoring system, rather than frustrating its function. Moreover, the pin deck lighting and sound system must be of such a nature as to facilitate standard bowling, with a fluorescent illumination of the pin deck, when the environment of light and sound activity is not desired.

DISCLOSURE OF THE INVENTION

In light of the foregoing, it is a first aspect of the invention to provide a light and sound system for a bowling pin deck that allows for the provision of a light show upon the pins of the pin deck themselves.

Another aspect of the invention is the provision of a light and sound system for a bowling pin deck in which light activity upon the pin deck may be coordinated with a sound system as to volume, frequency, and the like.

Still a further aspect of the invention is the provision of a light and sound system for a bowling pin deck that is conducive to implementation with infrared lighting to accommodate automatic scoring systems, without interference.

Still a further aspect of the invention is the provision of a light and sound system for a bowling pin deck that accommodates standard fluorescent lighting for the pin deck when light and sound activity is not desired.

Yet another aspect of the invention is the provision of a light and sound system for a bowling pin deck that is simple in design and construction, and readily conducive to implementation with presently existing bowling alleys, without structural change or modification.

The foregoing and other aspects of the invention which will become apparent as the detailed description proceeds are achieved by an enhancement system for a bowling pin deck, comprising: a light assembly positioned above and forwardly of a bowling pin deck, said light assembly having an array of light emitting diodes positioned to cast light therefrom upon the pin deck; and a controller interconnected with said light assembly, said controller regulating the illumination of said array of light emitting diodes.

Additional aspects of the invention that will become apparent herein are attained by a pin deck lighting system for a bowling facility, comprising: a light fixture positioned above and forward of a pin deck, said light fixture having a fluorescent lamp extending thereacross and a light plate beneath said fluorescent lamp and extending therewith, said light plate having a matrix of light emitting diodes therein; and a controller connected to said light fixture, said controller regulating illumination of said fluorescent lamp and said light emitting diodes.

BRIEF DESCRIPTION OF DRAWINGS

For a complete understanding of the aspects, structure and techniques of the invention, reference should be made to the following detailed description and accompanying drawings wherein.

DETAILED DESCRIPTION OF PREFERRED EMBODIMENT

Figure 1:
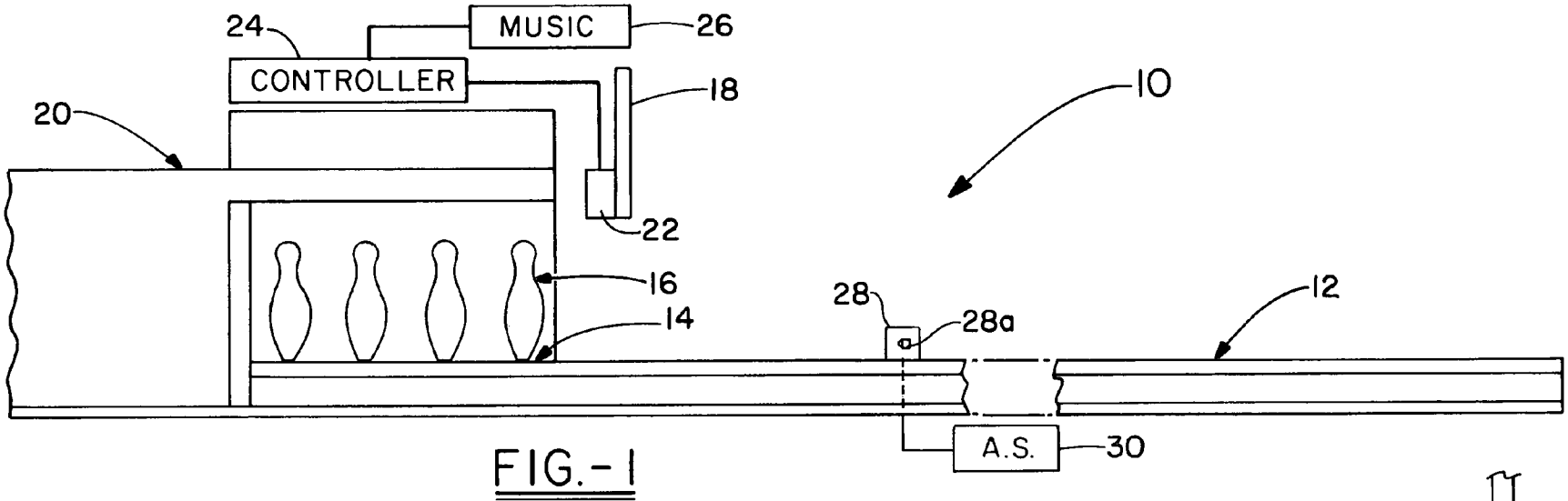
FIG. 1 is a side elevational view of a bowling lane showing the structure of the invention in association therewith.

Referring now to the drawings and more particularly to FIG. 1, it can be seen that a bowling lane of a bowling facility or center is designated generally by the numeral 10. As is well known, each bowling lane 10 includes an alley 12, constructed of wood or the like, extending from an approach area (not shown) to a pin deck area 14. The pin deck area 14 of the alley 12 is adapted to receive a set of ten pins 16 in triangular arrangement offset and behind a masking facia 18. A pin setter assembly 20 is positioned at the end of the alley 12 and behind the pin deck 14, as shown. The pin setter assembly is adapted to retrieve fallen pins, and to reset pins left standing for an attempted "spare," and to reset all pins at the end of the frame. Pin setter assemblies 20 are well known in the art.

In accordance with the invention, a light assembly 22 replaces the conventional pin deck light assembly that is mounted at the forward end of the pin setter 20 near the at rest position of the sweep bar. For purposes of simplicity here, the light assembly 22 is shown mounted to the back of the masking facia 18, above and in front of the pin deck 14, to illuminate the pin deck 14 under control of the controller 24. A music system 26 is also interconnected with the controller 24 to provide music and sounds in association with the pin deck, as desired. According to the invention, the controller 24 may control the operation of the light assembly 22 and the music system 26 in conjunction with each other, or separate and apart from each other. In other words, the combination of lights, their frequency of change, and their color combinations may be controlled directly by a program of the controller 24, or alternatively be controlled by the frequency of the sound or music emitted by the music system 26, through the controller 24. The use of sound frequency to vary light combinations and the switching of light colors is, of course, well known in the art.

Figure 2:
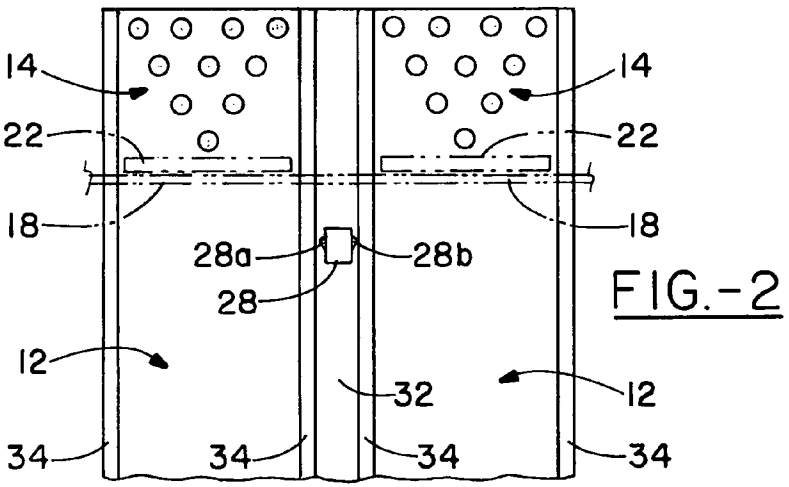
FIG. 2 is a top plan view of an adjacent bowling alley showing certain features of the invention.

As shown in FIGS. 1 and 2, a camera 28 is positioned between alleys 12, with lenses 28*a*, 28*b* focusing upon associated pin decks 14. The camera 28 is employed with the automatic scorer, to detect pins left standing at the end of each bowling frame or mid-frame to ensure the score is properly kept. It will be appreciated that, with the camera 28 positioned between each of the adjacent alleys, the pin decks 14 are viewed from opposite angles such that accurate counts are attained and there are no hidden and undetected pins. Placing cameras 28 upon the lane divider areas 32 between adjacent alleys 12, and with associated lens 28*a* and 28*b* focused on respective pin decks 14, such that two lenses are directed toward each pin deck 14, it is ensured that an accurate count of remaining pins, and their placement, is sensed and passed to the automatic scorer 30. As those skilled in the art know, the automatic scorer 30 maintains the score of individual bowlers on individual alleys.

As shown, gutters 34, defining the outermost edges of the alleys 12, are positioned immediately between the alleys 12 and associated lane dividers 32.

Figure 3:
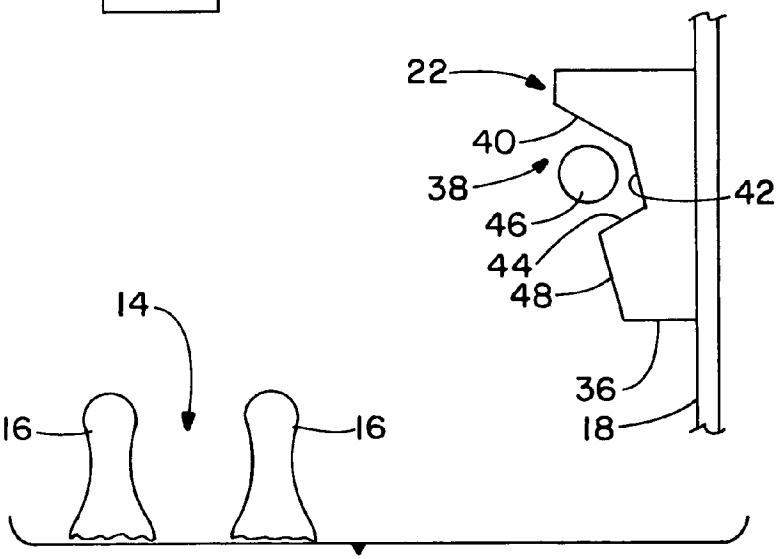
FIG. 3 is schematic illustration of the light assembly of the invention, shown mounted above the bowling lane and in association with the pins of the pin deck.

With reference now to FIG. 3, it can be seen that the light system 22 mounted to the forward end of the pin setter assembly 20, or illustratively to the back of the masking facia 18, comprises an elongated housing 36 having a frontal portion angled slightly downwardly toward the pin deck 14. The elongated housing 36 is mounted centrally over the alley 12 and includes an elongated downwardly angled receptacle 38 comprising a top plate 40, back plate 42, and bottom plate 44, all of which are angled slightly downwardly toward the pin deck 14. The receptacle 38 is adapted to receive a fluorescent bulb 46, to provide standard lighting to the pin deck 14. The plates 40, 42, 44 are preferably provided with a highly reflective light surface, such as baked white enamel or the like.

Positioned beneath the receptacle 38 and again angled downwardly toward the pin deck 14 is a light plate 48. As will be presented in detail below, the light plate 48 is provided with an array of symmetrically positioned light emitting diodes (LEDs) in the visible and infrared (IR) ranges. Specifically, the LEDs include the combination of colors of red, blue and green, and also include infrared LEDs. The LEDs have a conical light dispersions in which, combined with their spacing laterally along the light plate 48 and their positioning above the pin deck 14 ensures full illumination of the deck 14. It will be apparent that the colored LEDs are provided for a light show or controlled and sequenced illumination of the pin deck 14 with various colors, combinations, durations and frequencies. As presented above, the controlled illumination of the colored LEDs and their various combinations, duty cycles and the like may be tied directly to the music system 26 through the controller 24, such that the sound and lighting are coordinated as to frequency, pitch, amplitude or the like.

The infrared LEDs are provided to work in association with the cameras 28 and the automatic scorer 30, for providing infrared illumination of the pin deck 14 at all times during use of the automatic scorer 30. Finally, as presented above, the fluorescent light 46 is provided for standard illumination of the pin deck 14 when controlled colored lighting of the pin deck 14 is not desired.

Figure 4:
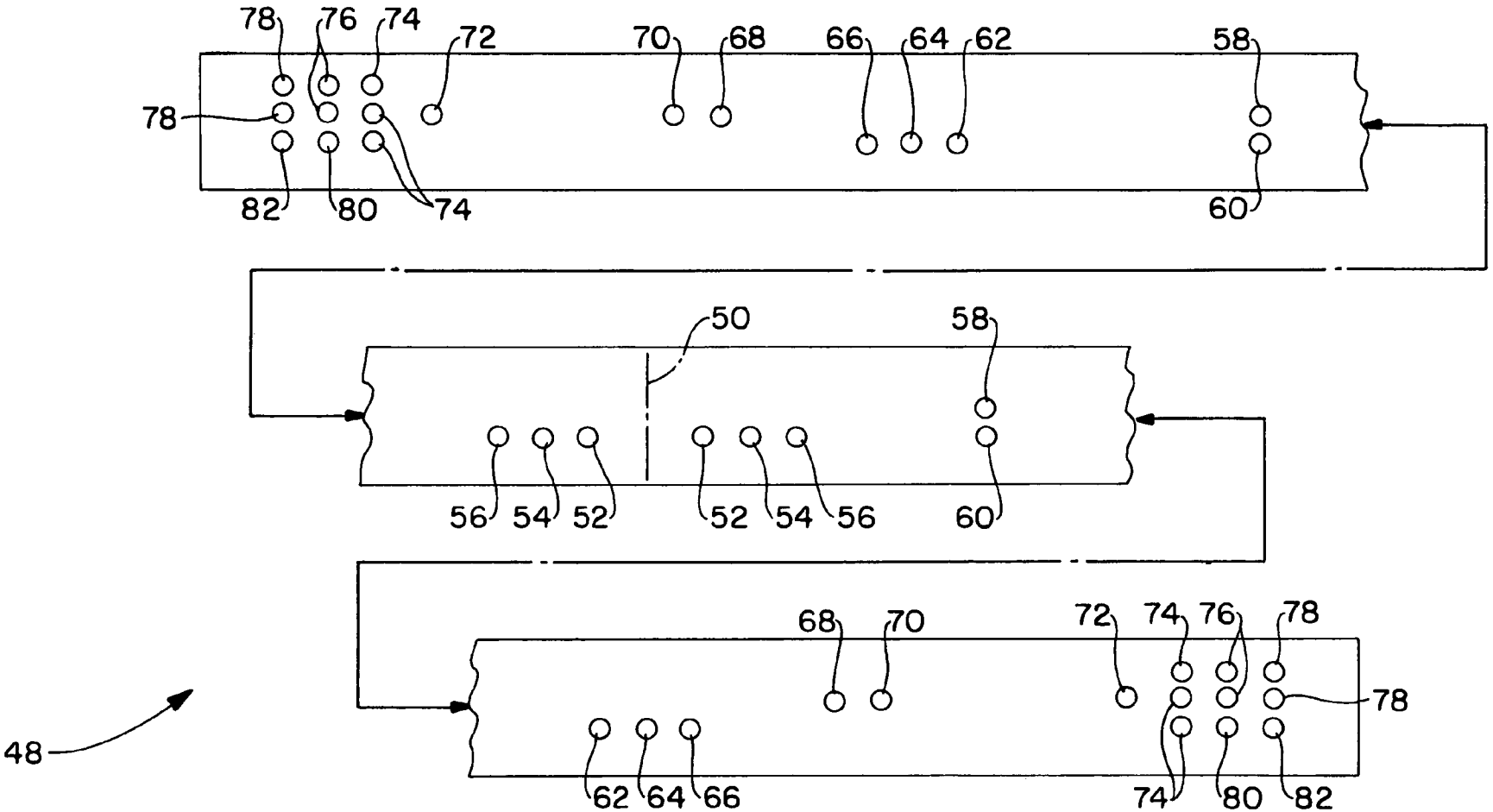
FIG. 4. Is a detailed illustration of the LED placement on the light plate of the invention.

With reference now to FIG. 4, an appreciation can be obtained of the specific desired structure of the light plate 48. Various sizes and dimensions will be presented below with respect to what testing and experimentation has shown to be the best mode and preferred embodiment of the light plate 48. For all dimensions and specifications presented below, it is contemplated that a variance of 20% will work satisfactorily and, accordingly, the preferred embodiment of the invention is considered to extend to such a 20% deviation from the specifications presented herein.

With reference to FIG. 4, it can be seen that the light plate 48, again of a light reflective material such a white baked enamel or the like, is of symmetric configuration on opposite sides of a centerline 50. In the preferred embodiment of the invention, the light plate 48 has a height of 45 mm, and a length of 914 mm.

Moving in opposite sides of the centerline 50, a first LED 52 is provided as a blue LED having a 60° dispersion cone, offset from the centerline 50 by 19 mm. Next is a green LED 54, having a 60° dispersion cone, offset from centerline 50 by 34 mm. Finally, a red LED 56, having a 60° dispersion zone, is spaced from the centerline by 49 mm. Accordingly, offset on opposite sides of the centerline 50 are uniformly spaced LEDs of the basic colors of red, green and blue. Next, spaced from the centerline 50 by 111 mm is a blue LED 58 having a 30° dispersions angle, and an IR LED 60 having a 30° dispersion angle. Thence, continuing along the light plate 48, a red LED 62 having a dispersion angle of 30° is offset from the centerline by 209 mm. A blue LED 64 having a dispersion angle of 30° is offset from the centerline by 224 mm, and a green LED 66 having a dispersion cone angle of 30° if offset from the centerline by 239 mm.

Next, to facilitate the automatic scorer, additional IR LEDs 68, 70, 72, all having dispersions angles of 30°, are provided upon the light plate 48. The LED 68 is spaced from the centerline by 286 mm, the LED 70 by 302 mm, and the LED 72 by 381 mm.

At opposite ends of the light plate 48, an array of 9 colored LEDs are provided. First, a row of green LEDs 74, having a dispersion cone angle of 30°, is provided 400 mm from the centerline 50. Next, a pair of blue LEDs 76, each having a dispersion angle of 30°, is provided 415 mm from the centerline 50, while a pair of blue LEDs 78, each having a dispersion angle of 30° is provided 430 mm from the centerline 50. Provided immediately before the pair of blue LEDs 76 is a red LED 80, having a dispersion angle of 30°, and immediately before the blue LEDs 78 is a red LED 82, having a dispersion angle of 30°.

Preferably, the LEDs 74 are spaced from each other by 9 mm, as are the LEDs 80, 76 and LEDs 82, 78. Similarly, the LEDs 58, 60 are preferably spaced apart by 9 mm.

Those skilled in the art will appreciate that the controller 24 may be employed to control individual LEDs, color groups of LEDs, groups of LEDs in juxtaposition to each other, or the like. Further, the controller 24 may be programmed for random energization of the various LEDs, sequential controlled illumination, or illumination tied to and controlled by the music system 26. The LEDs may be illuminated at a frequency or of a duty cycle determined by the frequency, pitch, tempo or volume of the music system, so desired. Moreover, the light system of adjacent alleys may be controlled in tandem, or independently of each other.

Thus it can be seen that the aspects of the invention have been satisfied by the structure and system presented above.

The IR LEDs may be continually illuminated during such time that the automated scorer 30 is to be employed, the LEDs may be controlled for a light show, or the fluorescent lamp 46 may be illuminated for standard bowling. In all events, the light system 24 is directed to the pin deck 14, rather than to the bowling establishment in general. This system provides an aesthetic effect that is pleasant, enjoyable, and yet not overwhelming or distractive in the bowling environment.

While in accordance with the patent statutes only the best mode and preferred embodiment of the invention has been presented and described in detail, it is to be understood that the invention is not limited thereto or thereby. Accordingly, for an appreciation of the scope and breadth of the invention reference should be made to the following claims.

What is claimed is:

1. An enhancement system for a bowling pin deck associated with an alley, comprising:

an elongated light assembly positioned above and orthogonal to the alley and above and forwardly of the associated bowling pin deck, said light assembly comprising a light plate having an array of light emitting diodes positioned therein to cast light therefrom upon the pin deck, said light emitting diodes of said array within a center portion of said light plate have a dispersion angle of about 60°, and said light emitting diodes of said array in end portions of said light plate have a dispersion angle of about 30°; and a controller interconnected with said light assembly, said controller regulating the illumination of said array of light emitting diodes.

2. The enhancement system for a bowling pin deck according to claim 1, wherein said light emitting diodes are of various colors.

3. The enhancement system for a bowling pin deck according to claim 2, wherein certain of said light emitting diodes emit light in the infrared range.

4. The enhancement system for a bowling pin deck according to claim 3, wherein said colors of said light emitting diodes are red, green and blue.

5. The enhancement system for a bowling pin deck according to claim 1, wherein said array of light emitting diodes comprises 32 light emitting diodes of colored light and 8 infrared light emitting diodes.

6. The enhancement system for a bowling pin deck according to claim 1, wherein said light assembly further comprises a fluorescent light tube maintained above said light plate.

7. The enhancement system for a bowling pin deck according to claim 6, wherein said light assembly has a light reflective surface receiving said light emitting diodes and said fluorescent light tube.

8. The enhancement system for a bowling pin deck according to claim 7, wherein said light assembly is mounted to a forward end of a pin setter assembly, in front of and above the pin deck.

9. The enhancement system for a bowling pin deck according to claim 8, further comprising a sound system interconnected with said controller, said controller regulating the illumination of said array of light emitting diodes as a function of sounds emitted from said sound system.

10. A pin deck lighting system for a bowling facility, comprising:

a light fixture positioned above and forward of a pin deck, said light fixture having a fluorescent lamp extending thereacross and a light plate beneath said fluorescent lamp and extending therewith, said light plate having a matrix of light emitting diodes therein wherein said fluorescent lamp is received within a receptacle angled forwardly and downwardly upon the pin deck, and wherein said light plate is also angled forwardly and downwardly upon the pin deck; and a controller connected to said light fixture, said controller regulating illumination of said fluorescent lamp and said light emitting diodes.

11. The pin deck lighting system according to claim 10, wherein said light emitting diodes are symmetrically positioned along said light plate with respect to a centerline of said light plate.

12. The pin deck lighting system according to claim 11, wherein said light emitting diodes are in the visible color and infrared ranges of illumination.

13. The pin deck lighting system according to claim 12, wherein said light emitting diodes in a center portion of said light plate on opposite sides of said center line have a light dispersion cone of about 60°, and the light emitting diodes in end portions of said light plate, on either side of said center portion, have cone angles of about 30°.

14. The pin deck lighting system according to claim 13, wherein said light emitting diodes in said visible color range are selected from the group of blue, red and green.

15. The pin deck lighting system according to claim 13, further comprising a sound system interconnected with said controller.

16. The pin deck lighting system according to claim 15, wherein said controller regulates illumination of said light emitting diodes in the visible color range as a function of frequency of a music output of said sound system.

17. The pin deck lighting system according to claim 16, wherein said controller regulates illumination of said light emitting diodes in the visible color range as a function of a tempo of said music output of said sound system.

* * * * *